United States Patent [19]

Wehr et al.

[11] Patent Number: 4,618,751

[45] Date of Patent: Oct. 21, 1986

[54] ARC EXTINGUISHING ASSEMBLY

[75] Inventors: Eugene W. Wehr; Clark L. Oster; Terence J. Evans, all of Cedar Rapids, Iowa

[73] Assignee: Square D Company, Palatine, Ill.

[21] Appl. No.: 684,559

[22] Filed: Dec. 21, 1984

[51] Int. Cl.[4] ..... H01H 33/08

[52] U.S. Cl. ..... 200/144 R; 200/147 R

[58] Field of Search ..... 200/144 R, 147 R, 147 B

[56] References Cited

U.S. PATENT DOCUMENTS

| | | | |
|---|---|---|---|
| 2,393,164 | 1/1946 | Hobson | 200/147 B |
| 2,734,970 | 2/1956 | Spears, Jr. | 200/147 B |
| 3,621,169 | 11/1971 | Heft et al. | 200/144 R |
| 4,011,425 | 3/1977 | Gryctko | 200/144 R |

FOREIGN PATENT DOCUMENTS

| | | | |
|---|---|---|---|
| 192266 | 2/1967 | U.S.S.R. | 200/144 R |

*Primary Examiner*—Robert S. Macon

*Attorney, Agent, or Firm*—Larry I. Golden; Richard T. Guttman

[57] ABSTRACT

An arc suppressing assembly for use in a circuit breaker having at least one pair of separable contacts which includes an arc stack assembly in back-to-back relationship with a baffle assembly with the arc stack assembly in between the baffle assembly and the separablecontacts. The arc stack assembly includes a pair of insulating support legs having a plurality of parallel slots which receive tabs of respective and generally rectangular-shaped arc plates with a recessed front portion of each arc plate facing toward the contacts. The uppermost arc plate is provided with an extending runner portion which attracts an arc formed upon the opening of the contacts under certain current conditions. The baffle assembly similarly includes a pair of insulating side supports with a plurality of parallel slots provided therein to receive tab portions provided on the sides of generally rectangular insulating baffles. The association of the insulating baffles with the metallic arc plates imparts a generally wave-like motion to the venting gases. Each of the plates are at an angle of substantially 22° to the horizontal with the gases first being directed upward by the arc plates and then downward by the baffles. A second set of baffles is provided behind a first column of baffles which are positioned in generally parallel relationship with the arc plates and further assist in the extinguishing and venting of the gases as they are blown away from the contacts.

7 Claims, 8 Drawing Figures

ARC EXTINGUISHING ASSEMBLY

BACKGROUND OF THE INVENTION

1. Field of the Invention

The present invention relates to arc suppressing and venting assemblies for a circuit breaker and more specifically to a louvered stack and baffle assembly for such purpose.

2. Description of the Prior Art

Most arc stacks for circuit breaker venting structures are designed to release arc gas products from the circuit breaker in a manner to aid in the interruption of the circuit and to vent the gases in a safe manner, i.e., by cooling and deionizing the gases to prevent or eliminate tendencies to cross phase or to strike grounded metal parts. Many methods for venting use multiple, generally parallel perforated vertical plates providing a series of chambers causing changes in the direction of gaseous flow resulting in turbulence and an attendant cooling of the moving gases. The forced flow of gases through the obstacle pathway provides a restriction of gas flow which causes high chamber pressures within the circuit breaker casing. Also, space constraints often require that the arc extinguishing assembly take up a limited amount of space within the casing.

SUMMARY OF THE INVENTION

The present invention provides a back to back louvered arc stack and baffle arrangement which facilitates relatively free flow of gases while sufficiently cooling and deionizing the gases.

An arc stack is provided immediately adjacent a generally O-shaped magnet within which the circuit breaker contacts are disposed. The arc stack consists of a plurality of generally parallel rectangular nickel plated steel plates which are spaced apart by approximately 0.2 inches and angled upward at approximately 22° in a direction away from the contacts. The nickel plated steel plates are provided with a tab at each opposite end which is received within a slot formed in each of the sides of the arc stack which is formed of a thermoset material such as polyester or melamine. One of the arc plates adjacent the top end of the stack is provided with a generally rectangular extending arc runner directed inward toward the center of the magnet at the same angle as the plate is positioned. Each of the other plates is provided with a recessed central portion on the side of the plates facing the contacts. A baffle assembly is positioned immediately behind the arc stack assembly and provides a plurality of insulating plates which channel the gases in a regular wave like motion. In previous designs with substantially tortuious paths for gas flow less than 30% of venting space was available while the present design provides approximately 60% of available venting space.

It is an object of this invention to adequately cool the venting gases while reducing the case pressure which builds up with the use of conventional venting arrangements.

It is a further object of the instant invention to provide an economical and a readily assembled arc venting assembly.

Another object is to provide an arc extinguishing assembly which balances the deionization of the gases with the case pressure within a given length of gaseous flow.

Further objects and features of the invention will be readily apparent to those skilled in the art from the following specification, includng the appended claims and the accompanying drawings of the invention in which:

DETAILED DESCRIPTION OF THE PREFERRED EMBODIMENT

Figure 4:
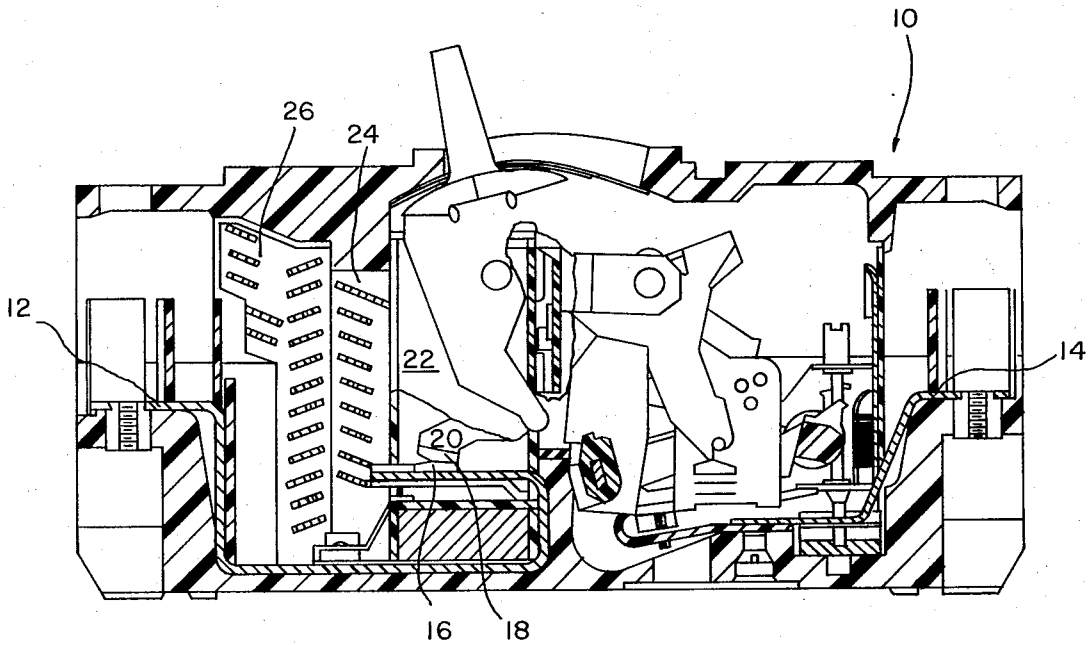
FIG. 4 is a side view of a single pole of a multiple circuit breaker incorporating the present arc extinguishing assembly.

A single pole of a multi-pole automatic electric circuit breaker 10 is shown in FIG. 4. The circuit breaker has a first terminal 12 and a second terminal 14 on the opposite side. The terminals are electrically connected through a pair of contacts, a first stationary contact 16 and a second movable contact 18 which is carried by a moveable blade 20. The contacts are positioned within an O-magnet 22 as further described in copending application Ser. No. 684,558 filed Dec. 21, 1984 by Lang, Cook, Evans and Oster for Improved Current Limiting Circuit Breaker filed concurrentely herewith, the disclosure of which is hereby incorporated by reference.

As shown in FIG. 4 the arc extinguishing assembly comprises an arc stack assembly 24 in facing relationship to the O-shaped magnet and a baffle assembly 26 in facing relationship with the arc stack assembly.

Figure 1:
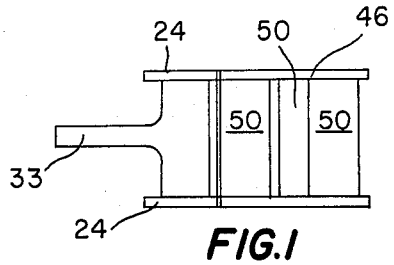
FIG. 1 is a top view of the arc extinguishing assembly.
Figure 2A:
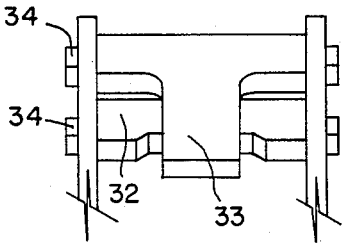
FIG. 2A is a partial front view showing the arc stack portion of the assembly.
Figure 2:
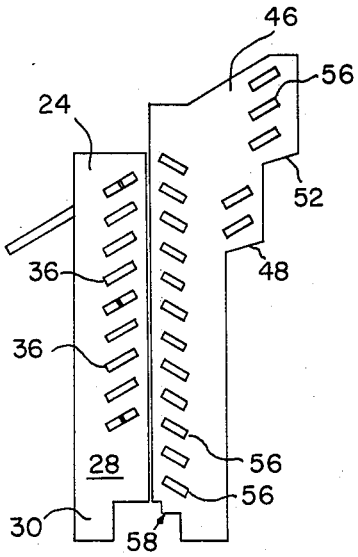
FIG. 2 is a side view of the arc extinguishing assembly.
Figure 3A:
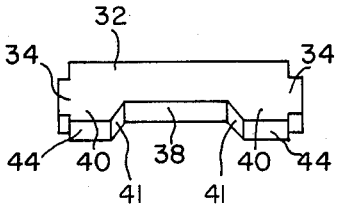
FIG. 3A is a front top view of an arc plate.
Figure 3:
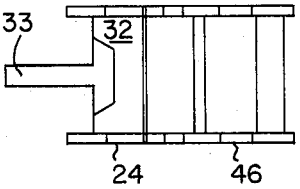
FIG. 3 is a bottom view of the arc extinguishing assembly.

The arc stack assembly which is also shown in FIGS. 2, 2A and 3A is provided with a pair of elongated generally rectangular side members 28 formed of a thermoset material such as a polyester glass or melamine which includes an extending leg segment 30 which rests upon the base of the circuit breaker. Each individual arc plate 32 may be formed from a generally rectangular suitable nickel plated steel plate and is provided with a pair of opposite tab portions 34 which fit into a respective slot 36 provided in the leg segment. The plurality of slots formed in the side of each arc stack are parallel and at approximately a 22° angle directed downward toward the center of the O-magnet. Each arc plate except for a runner plate which will be addressed later is also provided with a recessed front surface which provides an indented frontal section 38 that is flanked by a pair of wings 40 on each side. An inclined sidewall connects each side of the indented frontal section with the front edge 44 of the arc plate. The side wall extends at an angle toward the side of the plate which carries the tab 34. The recessed front surface helps prevent melting of the arc plates.

One of the arc plates adjacent the top portion of the arc stack which may be referred to as a runner plate 33 is provided with a generally rectangular extending runner which is received within the central portion of the O shaped magnet. In this particular embodiment, the top plate includes the arc runner which attracts the arc upon blow-open operation of the circuit breaker contacts. The arc stack provides an arc control zone which clips and sustains the voltage at a level which controls case pressure while forcing the current to zero. Once the arc path has transferred to the runner, it travels successively down the plates to the stationary contact. By lengthening the arc, the voltage is increased within the O-magnet.

Figure 2B:
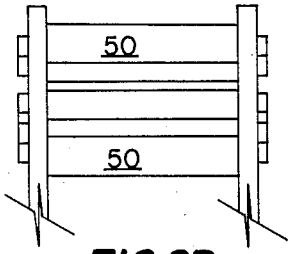
FIG. 2B is a partial front view showing the baffle portion of the assembly.
Figure 3B:
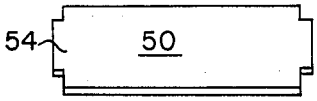
FIG. 3B is a front top view of a baffle plate.

The baffle assembly which is more specifically shown in FIGS. 2, 2B and 3B is positioned in facing relationship with the arc stack assembly on the opposite side from the O-magnet. The baffle assembly also includes a pair of side leg segments 46 formed of a similar material as the side members of the arc stack, however, it is provided with a first step portion 48 and a second step portion 52 at its top end to retain additional baffles as best shown in FIG. 2 and further described hereinafter.

The baffles 50 are formed of a generally rectangular insulating material such as is used for the side members and are also provided with a tab 54 at each side which is received within a respective slot 56 in the side member of the baffle assembly. The baffles and arc plates each have a thickness of approximately 0.064 inches.

The first row of slots are inclined downward at approximately 22 degrees directed away from the adjacent arc stack assembly. Each slot is spaced by approximately 0.2 of an inch and provide a plurality of parallel spaced apart baffles which channel the gases which have been directed upward from the arc plates in a downward direction without substantially restricting the flow. At the base of the first row of the baffle assembly is a cut out section 58 which is in facing relationship to a cut out segment at the base of the arc stack assembly provided adjacent to the leg segment of the side of the arc stack assembly. The first stepped portion of the side 48 is provided with a pair of slots which are directed upward away from the side adjacent the arc stack and the second step portion also includes a number of slots which are similarly directed upward away from the arc stack assembly. Suitable insulating material is also provided adjacent the baffle assembly along the lower portion of the assembly as well as extending upward adjacent the first step segment. This directs gases away from the terminal and lug assemblies of the circuit breaker.

It has been found that this particular combination, i.e., an arc stack assembly in facing relationship with the baffle assembly which provides a directed wave like motion of gases provides requisite extinguishing characteristics while facilitating sufficient flow of the gases to avoid undesirable pressure buildup within the breaker casing. The louvered arrangement of the arc plates and baffles provide a relatively low restriction to the gas flow while providing sufficient surface area for cooling and deionizing the arc gases produced within the circuit breaker.

The arc plates and baffles may be secured within the respective side members by force fit or may be further secured through the use of an adhesive where the tabs extend through the slots. Alternatively, the tabs could fit loosely within the slots with the molded casing of the circuit breaker holding the side members in position. Ribs may also be provided on the side walls of each pole to assist in retaining the side members in position with the circuit breaker casing.

In operation, the arc will be drawn from the contact on the movable blade to the arc runner as the arc is blown outward and the gases will continue to flow in the outward direction through the path provided by the arc plates and baffles providing the necessary deionization for the arc gases.

While the invention has particularly been shown and described with reference to a preferred embodiment, it will be understood by those skilled in the art that variations and form, construction and arrangements may be made therein without departing from the spirit and scope of the invention. All such variations are intended to be covered in the appended claims.

What we claim is:

1. An arc suppressing assembly for a circuit breaker having at least one pair of separable contacts comprising;

an arc stack assembly;

a baffle assembly in facing relationship with said arc stack assembly, said arc stack assembly intermediate said baffle assembly and said contacts;

said arc stack assembly comprising a pair of insulating support legs having a plurality of slots provided therein, a plurality of arc plates having a tab at each side, said tabs respectively received within said slots of the side legs to retain said arc plates between said side legs, said baffle assembly comprising a pair of insulating side supports including a plurality of slots provided therein, a plurality of insulating baffles provided with a tab at each side, said tabs received within respective slots within said side supports.

2. An arc suppressing assembly as claimed in claim 1 wherein said arc plates are in parallel relationship with each other.

3. An arc suppressing assembly as claimed in claim 2 wherein said baffle assembly includes a first set of baffles, said baffles positioned in parallel relationship with each other.

4. An arc suppressing assembly as claimed in claim 3 wherein each said arc plate defines a respective arc plate plane and each said baffle defines a respective baffle plane, said assembly having a vertical axis plane defined by a plane substantially intermediate said arc stack assembly and said baffle assembly and extending in a transverse direction to each of said arc plate planes and each of said baffle planes, said assembly having a horizontal axis plane substantially 90° to said vertical axis plane, each of said arc plate planes forming an angle of approximately 22° with said horizontal axis plane and each of said baffle planes positioned at substantially 22° to said horizontal axis plane.

5. An arc suppressing assembly as claimed in claim 4 wherein each of said arc plate planes intersect each of said baffle planes.

6. An arc suppressing assembly as claimed in claim 5 including a second set of baffles carried by said side supports with said first set of baffles intermediate said arc plates and said second set of baffles;

said second set of baffles defining a second set of baffle planes in parallel relationship with said arc plate planes.

7. An arc suppressing assembly as claimed in claim 4 wherein said contacts are positioned within an O-shaped magnet, said arc stack assembly being positioned directly between said magnet and said baffle assembly.

* * * * *